US007878843B2

(12) United States Patent
Zhang

(10) Patent No.: US 7,878,843 B2
(45) Date of Patent: Feb. 1, 2011

(54) CABLE ASSEMBLY HAVING HOLD-DOWN ARRANGEMENT

(75) Inventor: Han-Ming Zhang, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/541,170

(22) Filed: Aug. 14, 2009

(65) Prior Publication Data

US 2010/0159740 A1 Jun. 24, 2010

(30) Foreign Application Priority Data

Dec. 23, 2008 (CN) ..... 200820303593

(51) Int. Cl.
*H01R 12/24* (2006.01)

(52) U.S. Cl. ..... 439/497; 439/579

(58) Field of Classification Search ..... 439/497–499, 439/579, 597, 607.07, 607.13, 607.49
See application file for complete search history.

(56) References Cited

U.S. PATENT DOCUMENTS

| | | | | |
|---|---|---|---|---|
| 6,371,771 | B1 * | 4/2002 | Fan | 439/79 |
| 6,454,606 | B2 | 9/2002 | Igarashi | |
| 7,311,552 | B1 * | 12/2007 | Ko | 439/579 |
| 7,361,049 | B2 * | 4/2008 | Nagata et al. | 439/497 |
| 7,377,803 | B2 * | 5/2008 | Matsuoka | 439/497 |
| 7,601,029 | B2 * | 10/2009 | Horiuchi et al. | 439/607.01 |

* cited by examiner

*Primary Examiner*—Thanh-Tam T Le
(74) *Attorney, Agent, or Firm*—Ming Chieh Chang; Wei Te Chung; Andrew C. Cheng

(57) ABSTRACT

Provided is a cable assembly comprises an insulative housing having a plurality of contact terminals disposed therein. A plurality of conductive wires each is terminated with the plurality of contact terminals. And a hold-down arrangement is securely attached to the housing, and includes a metallic base portion substantially covering interconnection between the contact terminals and the conductive wires. The arrangement includes a first anchors interlocked to the housing, and a second anchors extending beyond a mating interface of the housing.

17 Claims, 5 Drawing Sheets

CABLE ASSEMBLY HAVING HOLD-DOWN ARRANGEMENT

BACKGROUND OF THE INVENTION

1. Field of the invention

The present invention relates to a cable assembly, and more particularly, to a cable assembly incorporated with a hold-down arrangement such that when the cable assembly is interconnected with a receptacle mounted onto a printed circuit board, an anchor from the hold-down arrangement will engage with a via of printed circuit board facilitating reliable and robust interconnection therebetween.

2. Description of Related Art

An electrical connector is used for electrically connecting a cable to a PCB. As disclosed in U.S. Pat. No. 6,454,606 issued to Igarashi on Sep. 24, 2002, an electrical connector for mating with a mating connector and connecting a cable to a PCB includes an insulating housing, a plurality of contacts retained in the insulating housing and a shell member assembled on the insulating housing. The insulating housing includes a longitudinal base portion and a tongue plate extending horizontally along a mating direction from said base portion. A plurality of receiving grooves are formed on the base portion and the tongue plate for receiving the contacts horizontally. The cable has a front contacting end for contacting with said contacts and a back end extending out from the insulating housing. The shell member engages with insulating housing at two longitudinal ends of the housing and defines a receiving room therebetween for receiving said cable. During the mating process of the electrical connector, the shell member can not engage with the mating connector. As a result, the shell member fails to provide a steady connection when an external shock or an external force applied to the electrical connector and the mating connector, which may result the connection between the electrical connector and the mating connector becoming unstable.

So it is necessary to provide a new electrical connector to solve the problems above.

SUMMARY OF THE INVENTION

Accordingly, it is an object of the present invention to provide an electrical connector which can provide a stable connection.

In order to achieve above-mentioned object, An electrical connector comprises an insulating housing defining a mounting surface for retaining a plurality of cables and a mating surface parallel to the mounting surface for mating with a mating connector. A plurality of contacts are retained in said insulating housing. A shell member is assembled on the insulating housing for covering said mounting surface. The shell member includes at least one retaining leg extending downwardly for mounting on to a printed circuit board, the retaining leg defines an operating portion extending outwardly to provide an operation space for a user and a tip end adapted for being inserted into and mounted onto the printed circuit board.

In order to achieve the object set forth, provided herewith according to an embodiment of the present invention is a cable assembly comprises an insulative housing having a plurality of contact terminals disposed therein. A plurality of conductive wires each is terminated with the plurality of contact terminals. And a hold-down arrangement is securely attached to the housing. and includes a metallic base portion substantially covering interconnection between the contact terminals and the conductive wires. The arrangement includes a first anchors interlocked to the housing, and a second anchors extending beyond a mating interface of the housing.

According to another aspect of the present invention, provided herewith an interconnecting system, comprises a printed circuit board. A first connector is mounted onto the printed circuit board and includes at least a first contact. A cable assembly includes a second connector having a second connector having a second contact interengaged with the first contact when the first and second connector mate together, and at least a conductive wire is terminated to the second contact. And a hold-down arrangement having a pair of boardlocks interlocked with the printed circuit board to encapsulate the first and second connector to the printed circuit board for ensuring reliable interconnection between the first and second connectors.

Still according to one aspect of the present invention, the boardlock is provided with a stop to limit its insertion into the printed circuit board.

Still according to one aspect of the present invention, the boardlock includes a removal aid to facilitate easy withdrawal of the boardlock from the printed circuit board.

Other objects, advantages and novel features of the present invention will become more apparent from the following detailed description of the present embodiment when taken in conjunction with the accompanying drawings.

DETAILED DESCRIPTION OF THE INVENTION

Figure 1:
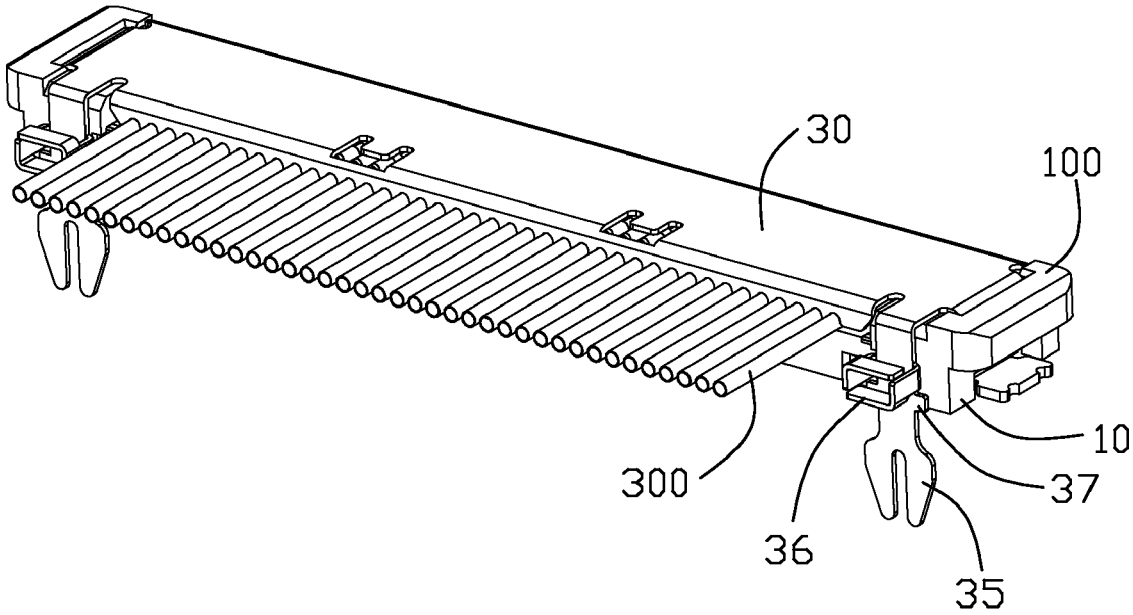
FIG. 1 is a perspective view of the cable connector in accordance with the present invention after mating with a mating connector.

The present invention shall be discussed hereinafter in terms of a preferred embodiment illustrated in the accompanying drawings. In the following description, numerous specific details are set forth in order for the reader hereof to gain a thorough understanding of the present invention. It will be obvious, however, to those skilled in the art that certain well-know elements may not be shown in detail in order to unnecessarily obscure the present invention.

Referring to FIGS. 1 to 4, an electrical connector 100 used for connecting with cables 300 and mating with a mating connector 200, includes an insulating housing 10, a plurality of contacts 20 retained in the insulating housing 10, a shell member 30 covered on the insulating housing 10 and a retaining bar 40 retained in the insulating housing for engaging with the cables 300, the shell member 30 and the retaining bar 40 are commonly entitled to a hold-down arrangement.

Figure 2:
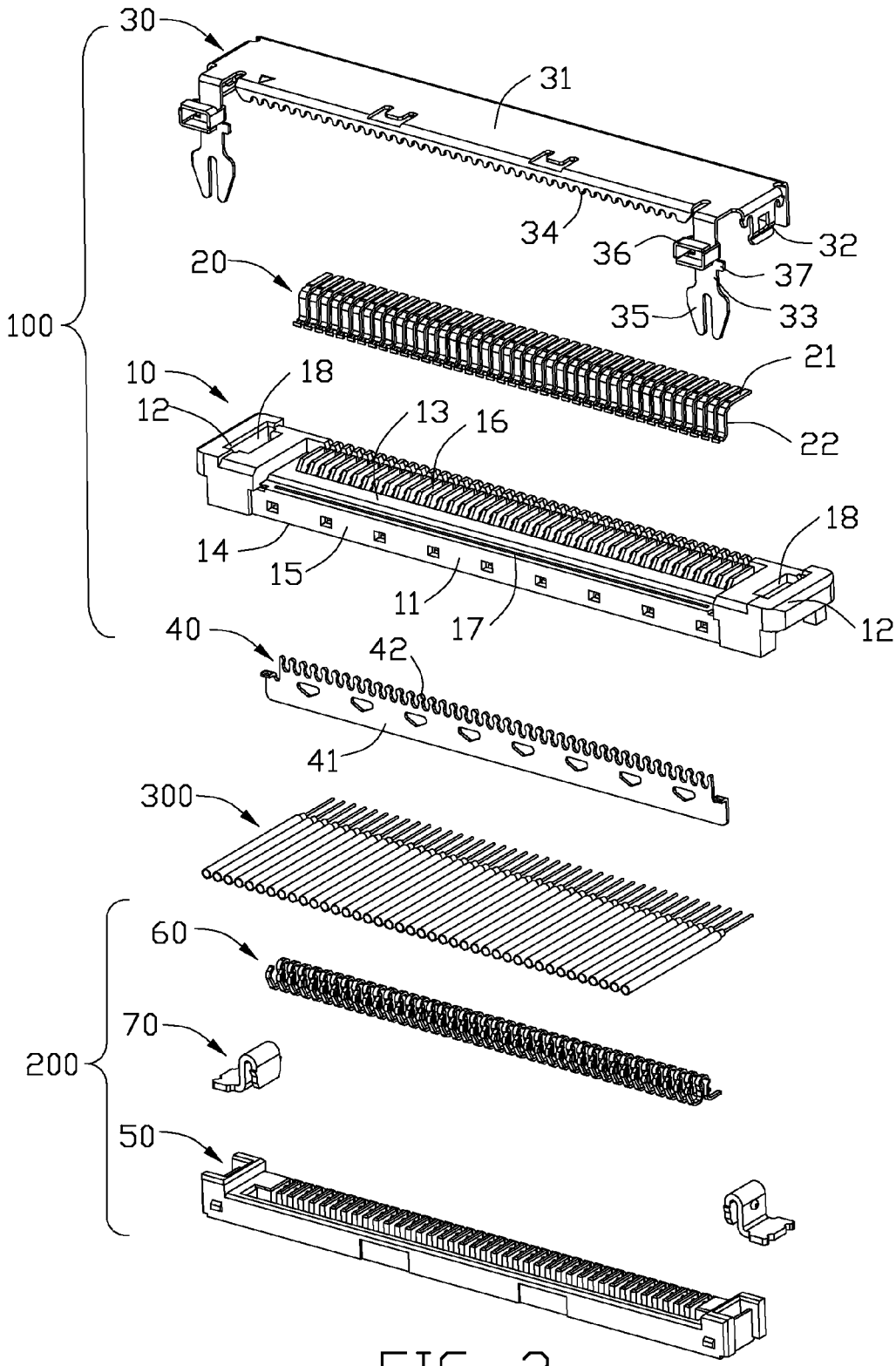
FIG. 2 is an exploded perspective view of the cable connector and the mating connector of FIG. 1.
Figure 3:
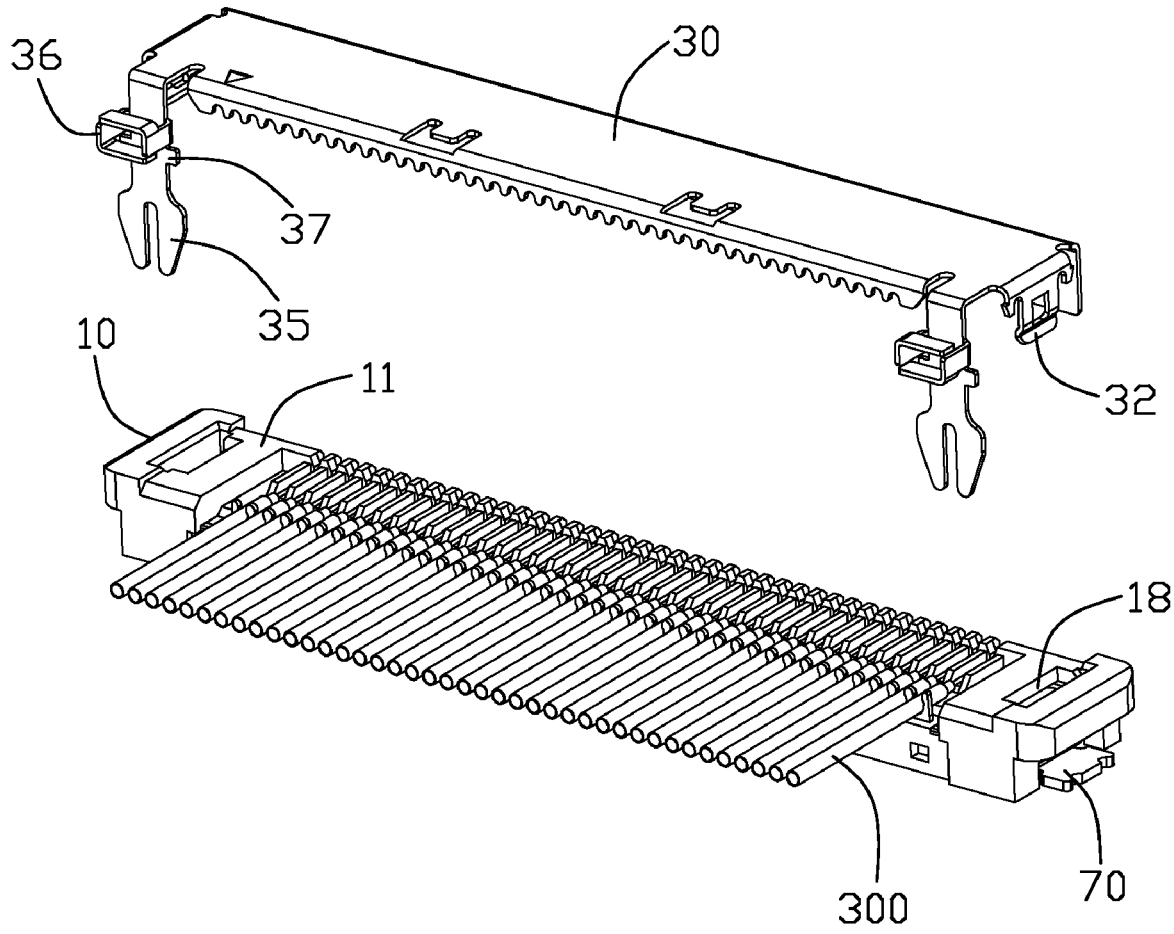
FIG. 3 is a partial exploded perspective view of the cable connector of FIG 1 after mating with the mating connector.
Figure 4:
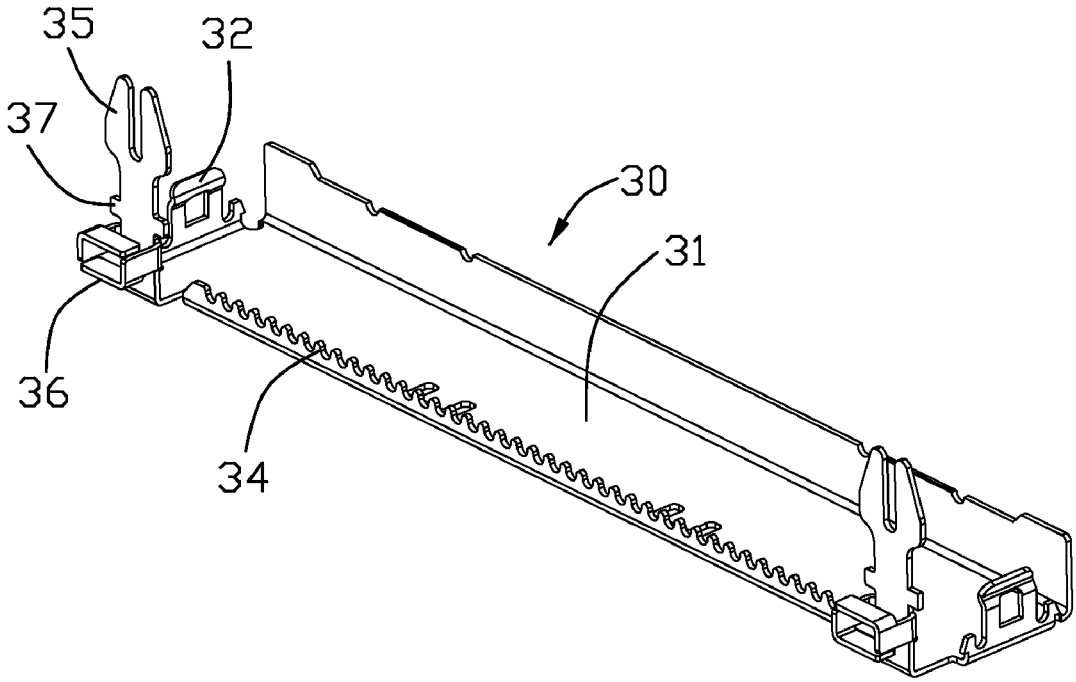
FIG. 4 is a perspective view of the shell member of FIG. 1 from a bottom view.
Figure 5:
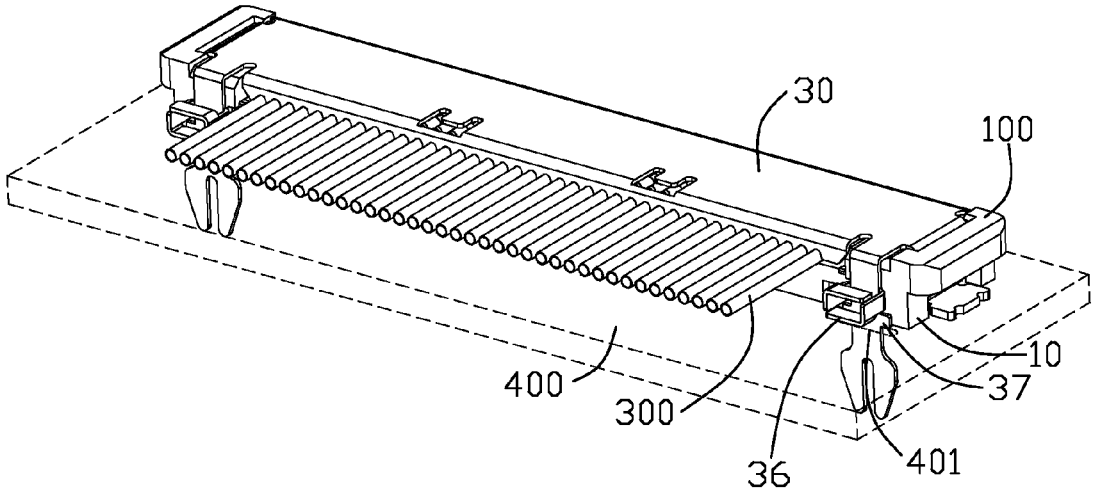
FIG. 5 is a perspective view of the connector assembly mounted onto a printed circuit board.

In FIG. 2, the insulating housing 10 has a longitudinal base portion 11 and a pair of mounting portions 12 formed on two longitudinal ends of the base portion 11. The base portion 11 defines a mounting surface 13 on a top side of the insulating housing 10 for sustaining the cables 300, a mating surface 14 on a bottom side of the insulating housing 10 for mating with a mating connector 200 and a pair of lateral side surfaces 15 connecting with said mounting surface 13 and mating surface 14. Said mounting surface 13 defines a plurality of receiving grooves 16 depressed thereon for receiving the contacts 20 and a longitudinal receiving slot 17 adjacent to the lateral side surface 15 of the insulating housing 10 for receiving the retaining bar 40. The mounting portion 12 extends longitudinally and defines thereon a retaining hole 18 which extends downwardly for engaging with the shell member 30.

Referring to FIG. 2, the contact 20 is L-shaped and downwardly assembled onto the mounting surface 13 of the insulating housing 10. The contact 20 includes a horizontal first contacting beam 21 for mating with the cable 300 and a vertical second contacting beam 22 extending downwardly from one end of the first contacting beam 21 and extending toward the mating surface 14 for mating with the mating connector 200.

Referring to FIGS. 2-5, the shell member 30 downwardly assembled onto the insulating housing 10 and defines a receiving space for receiving the cables 300. Said shell member 30 includes a longitudinal cover 31, a pair of retaining tabs 32 extending downwardly from two longitudinal ends of the cover 31 and a pair of retaining legs 33 adjacent to said retaining tabs 32. The retaining tabs and the retaining leas can also be designated as anchors, boardlocks and the like. Said cover 31 has a longitudinal lateral edge (also named as a skirt portion), which defines a plurality of engaging tabs 34 extending downwardly and defining a plurality of auxiliary positioning slots therebetween for engaging with the cables 300 securely. The retaining tab 32 is inerted into and fixed in the retaining hole 18 of the insulating housing 10 so that the shell member 30 can be retained on the insulating housing 10 securely. The retaining legs 33 are formed on said lateral edge of the cover 31 and located at two ends of said engaging tabs 34. Said retaining leg 33 extends downwardly beyond the mating surface 14 and has a tip end defining a pair of mounting portions 35 for being inserted into a through hole 401 on a printed circuit board (PCB) 400, an operating portion 36 (also named as a removal aid) formed on a top side of the mounting portions 35 and a pair of blocking tabs 37 located between said mounting portions 35 and said operating portion 36. Said mounting portions 35 are formed as a fork and extend downwardly to insert into the through hole 401 on the PCB 400 for providing a stable retention. Said operating portion 36 is outwardly bended from two sides of the retaining leg 33 and consists of two opposite arms. The opposite arms of the operating portion 36 extend apart away from the insulating housing 10 along the cables 300 and are used for being moved vertically by an operator so that the shell member 30 can be assembled onto the insulating housing 10 or removed from the insulating housing 10 conveniently and easily. Said blocking tabs 37 protrude from two sides of the retaining leg 33 horizontally for abutting on a surface of the PCB to prevent the retaining leg 33 from being over-deeply inserted into the through hole in the PCB, therefore the blocking tab 37 is also called a stop.

The retaining bars 40 is formed by a metal plate and has a longitudinal base body 41 assembled into the insulating housing 10 downwardly. Said base body 41 is retained into the receiving slot 17 of the insulating housing 10 and defines a plurality of retaining fingers 42 on a top edge thereof which extend upwardly onto the mounting surface 13 for engaging with cables 300.

As referring to FIG. 2, a mating connector 200 is used for being mounted on the PCB and mating with the electrical connector 100 vertically. Said mating connector 200 includes a longitudinal housing 50, a plurality of terminals 60 retained in the housing 50 for mating with said contacts 20 and a pair of holding members 70 retained on two ends of the housing 50 for being mounted on the PCB.

During the assembly, the operator can grasp the operating portion 36 of the shell member 30 for assembling or removing the shell member easily. After the electrical connector 100 mates with the mating connector 200, the retaining legs 33 with said forked mounting portions 35 of the shell member 30 are inserted into the PCB for providing a stable retention therebetween, which also ensures a stable connection between the electrical connector 100 and the mating connector 200.

However, while the preferred embodiment of the invention have been shown and described, it will apparent to those skilled in the art that changes and modifications may be made therein without departing from the spirit of the invention, the scope of which is defined by the appended claims.

What is claimed is:

1. An electrical connector comprising:

an insulating housing defining a mounting surface for retaining a plurality of cables and a mating surface parallel to the mounting surface for mating with a mating connector;

a plurality of contacts retained in said insulating housing;

a shell member assembled on the insulating housing for covering said mounting surface; wherein said shell member includes at least one retaining leg extending downwardly for mounting on to a printed circuit board, the retaining leg defines an operating portion extending outwardly thereby defining an operation space for a user and a tip end adapted for being inserted into and mounted onto the printed circuit board.

2. The electrical connector as claimed in claim 1, wherein said tip end of the retaining leg defines a pair of mounting portions separated from each other and configured as a fork shape.

3. The electrical connector as claimed in claim 1, wherein the shell member has a cover located upon the mounting surface and defines a receiving space therebetween for receiving said cables, said cover has a longitudinal lateral edge defining a plurality of engaging tabs extending downwardly for engaging with the cables.

4. The electrical connector as claimed in claim 2, wherein the retaining leg further includes a pair of blocking tabs protruding from two sides thereof and located between the operating portion and the mounting portion.

5. The electrical connector as claimed in claim 4, wherein each of said contact is L-shaped and includes a first horizontal contacting beam and a second vertical contacting beam, said first contacting beam is located on said mounting surface of the insulating housing for mating with the cable, while the second contacting beam extends downwardly toward the mating surface of the insulating housing for mating with the mating connector.

6. The electrical connector as claimed in claim 5, wherein the electrical connector further comprises a retaining bar inserted into the insulating housing for engaging with the cables.

7. The electrical connector as claimed in claim 6, wherein said mounting surface defines a receiving slot adjacent to a lateral side surface of the insulating housing for receiving said retaining bar.

8. The electrical connector as claimed in claim 7, wherein said retaining bar has a plurality of retaining fingers on a top edge thereof, the retaining fingers extend upwardly toward the mounting surface for engaging with the cables.

9. The electrical connector as claimed in claim 8, wherein said shell member defines a plurality of engaging tabs extending toward said retaining fingers for holding the corresponding cables therebetween.

10. A cable assembly, comprising:

an insulative housing having a plurality of contact terminals disposed therein;

a plurality of conductive wires each terminated with the plurality of contact terminals;

a hold-down arrangement attached to the housing, and including a metallic base portion substantially covering interconnection between the contact terminals and the conductive wires, and having first anchors interlocked to the housing, and second anchors extending beyond a mating interface of the housing; and a removal aid on each of the second anchors.

11. The cable assembly as recited in claim 10, further comprising a metallic organizer secured to the housing and having a plurality of positioning slots each receives a corresponding conductive wire therein.

12. The cable assembly as recited in claim 11, wherein the metallic base portion having a skirt portion pushing the conductive wires against the positioning slots.

13. The cable assembly as recited in claim 12, wherein the skirt portion includes a plurality of auxiliary positioning slot.

14. The cable assembly as recited 10, further comprising a stop on each of the second anchors.

15. An interconnecting system, comprising:

a printed circuit board;

a first connector mounted onto the printed circuit board and including at least a first contact;

a cable assembly including a second connector having a second contact interengaged with the first contact when the first and second connector mated together, and at least a conductive wire terminated to the second contact;

a hold-down arrangement having a pair of boardlocks interlocked with the printed board to encapsulate the first and second connector to the printed circuit board for ensuring reliable interconnection between the first and second connectors; and a removal aid on each of the boardlocks faciliting easy removal of the boardlocks from the printed circuit board.

16. The interconnecting system as recited in claim 15, further providing a pair of anchors on the hold-down arrangement securely attached to the second connector.

17. The interconnecting system as recited in claim 15, further including a stop on the pair of boardlock to limit the insertion of the boardlock into the printed circuit board.

* * * * *